US008419240B2

(12) United States Patent
Lim

(10) Patent No.: US 8,419,240 B2
(45) Date of Patent: Apr. 16, 2013

(54) LIGHTING DEVICE

(75) Inventor: Dong Nyung Lim, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 0 days.

(21) Appl. No.: 13/293,473

(22) Filed: Nov. 10, 2011

(65) Prior Publication Data

US 2012/0051069 A1 Mar. 1, 2012

(30) Foreign Application Priority Data

Nov. 30, 2010 (KR) ..... 10-2010-0120548
Nov. 30, 2010 (KR) ..... 10-2010-0120549
Dec. 6, 2010 (KR) ..... 10-2010-0123717
Dec. 13, 2010 (KR) ..... 10-2010-0127084

(51) Int. Cl.
*F21V 29/00* (2006.01)

(52) U.S. Cl.
USPC ..... 362/373; 362/294; 362/646; 362/249.02

(58) Field of Classification Search ..... 362/294, 362/373, 249.02, 646, 650
See application file for complete search history.

(56) References Cited

U.S. PATENT DOCUMENTS 5,857,767 A * 1/1999 Hochstein ..... 362/294
7,766,513 B2 * 8/2010 Zhang et al. ..... 362/294
7,841,752 B2 * 11/2010 Lee ..... 362/373
7,874,699 B2 * 1/2011 Liang ..... 362/249.02
7,922,364 B2 * 4/2011 Tessnow et al. ..... 362/294
7,993,025 B2 * 8/2011 Chiu ..... 362/249.02
8,157,422 B2 * 4/2012 Paik et al. ..... 362/294
8,206,015 B2 * 6/2012 Cho et al. ..... 362/311.02
8,246,215 B2 * 8/2012 Lu et al. ..... 362/294
8,267,545 B2 * 9/2012 Chen ..... 362/249.02
8,272,762 B2 * 9/2012 Maxik et al. ..... 362/249.02
8,287,152 B2 * 10/2012 Gill ..... 362/249.02
2010/0072894 A1 3/2010 Shibahara et al.
2011/0164420 A1 * 7/2011 Lee ..... 362/249.02

FOREIGN PATENT DOCUMENTS

JP 2003-283038 10/2003
JP 2006-313718 11/2006
JP 2009-037995 2/2009
JP 2009-093926 4/2009
JP 3152234 7/2009
JP 2009-267082 11/2009

(Continued)

OTHER PUBLICATIONS

Japanese Office Action for 2011-254606 dated Feb. 7, 2013.

*Primary Examiner* — Anabel Ton
(74) *Attorney, Agent, or Firm* — Lowe Hauptman Ham & Berner, LLP

(57) ABSTRACT

A lighting device may be provided that includes a heat sink which includes one surface, a guide including a receiving portion, and a first projection disposed on an outer circumference of the one surface; a light emitting module which is disposed on the one surface of the heat sink; and a cover which is coupled to the heat sink and includes a locking projection coupled to the receiving portion of the heat sink, and includes a recess coupled to the first projection of the heat sink, wherein the heat sink and the cover are limited to separate from each other by the coupling of the locking projection and the receiving portion, wherein the cover is limited to rotate by the coupling of the first projection and the recess of the cover, and wherein the light emitting module include an lighting emitting diode.

19 Claims, 15 Drawing Sheets

FOREIGN PATENT DOCUMENTS

| | | |
|---|---|---|
| JP | 3156563 | 12/2009 |
| JP | 2010-045030 | 2/2010 |
| JP | 2010-146952 | 7/2010 |
| JP | 3162595 | 8/2010 |
| JP | 2010-231913 | 10/2010 |
| JP | 2010-257761 | 11/2010 |
| KR | 1020020039398 | 5/2002 |
| KR | 0322848 | 7/2003 |
| KR | 0335752 | 12/2003 |
| KR | 2008-0002870 | 7/2008 |
| KR | 1020080080711 | 9/2008 |
| KR | 10-0909472 | 7/2009 |
| KR | 2009-0010850 | 10/2009 |
| KR | 1020100052121 | 5/2010 |
| KR | 10-0965560 | 6/2010 |
| KR | 0449340 | 6/2010 |
| KR | 1020100064800 | 6/2010 |
| KR | 100981334 | 9/2010 |
| KR | 1020100104004 | 9/2010 |
| KR | 2010-0009895 | 10/2010 |
| KR | 1020100120992 | 11/2010 |
| KR | 1020100126064 | 12/2010 |
| KR | 10-1016496 | 2/2011 |
| WO | 2010/089397 | 8/2010 |

* cited by examiner

LIGHTING DEVICE

CROSS-REFERENCE TO RELATED APPLICATION

The present application claims priority under 35 U.S.C. §119(e) of Korean Patent Application No. 10-2010-0120548 filed Nov. 30, 2010, No. 10-2010-0120549 filed Nov. 30, 2010, No. 10-2010-0123717 filed Dec. 6, 2010, No. 10-2010-0127084 filed Dec. 13, 2010, the subject matters of which are incorporated herein by reference.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As there advantages are widely known, more and more attentions are now paid to a lighting apparatus using the LED.

The lighting apparatus using the LED are generally classified into a direct lighting apparatus and an indirect lighting apparatus. The direct lighting apparatus emits light emitted from the LED without changing the path of the light. The indirect lighting apparatus emits light emitted from the LED by changing the path of the light through reflecting means and so on. Compared with the direct lighting apparatus, the indirect lighting apparatus mitigates to some degree the intensified light emitted from the LED and protects the eyes of users.

SUMMARY

One embodiment is a lighting device. The lighting device includes: a heat sink which includes one surface, a guide including a receiving portion, and a first projection disposed on an outer circumference of the one surface; a light emitting module which is disposed on the one surface of the heat sink; and a cover which is coupled to the heat sink and includes a locking projection coupled to the receiving portion of the heat sink, and includes a recess coupled to the first projection of the heat sink, wherein the heat sink and the cover are limited to separate from each other by the coupling of the locking projection and the receiving portion, wherein the cover is limited to rotate by the coupling of the first projection and the recess of the cover, and wherein the light emitting module include an lighting emitting diode.

Another embodiment is a lighting device. The lighting device includes a heat sink including a flat surface and a guide which is disposed on an outer circumference of the surface and includes a projection; a light emitting module disposed on the surface; and a cover being coupled to the guide of the heat sink and including a hole corresponding to the projection. The cover is limited to rotate by the coupling of the projection of the guide and the hole of the cover. The heat sink and the cover are limited to separate from each other by the coupling of the projection of the guide and the hole of the cover.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
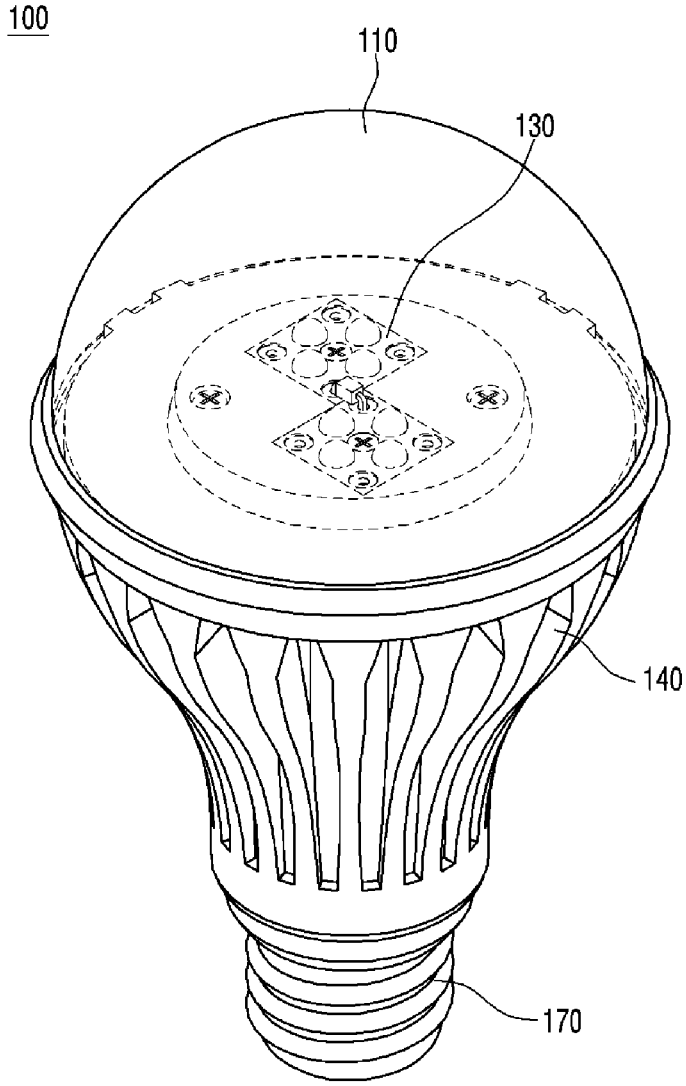
FIG. 1 is a perspective view showing an embodiment of a lighting device.
Figure 2:
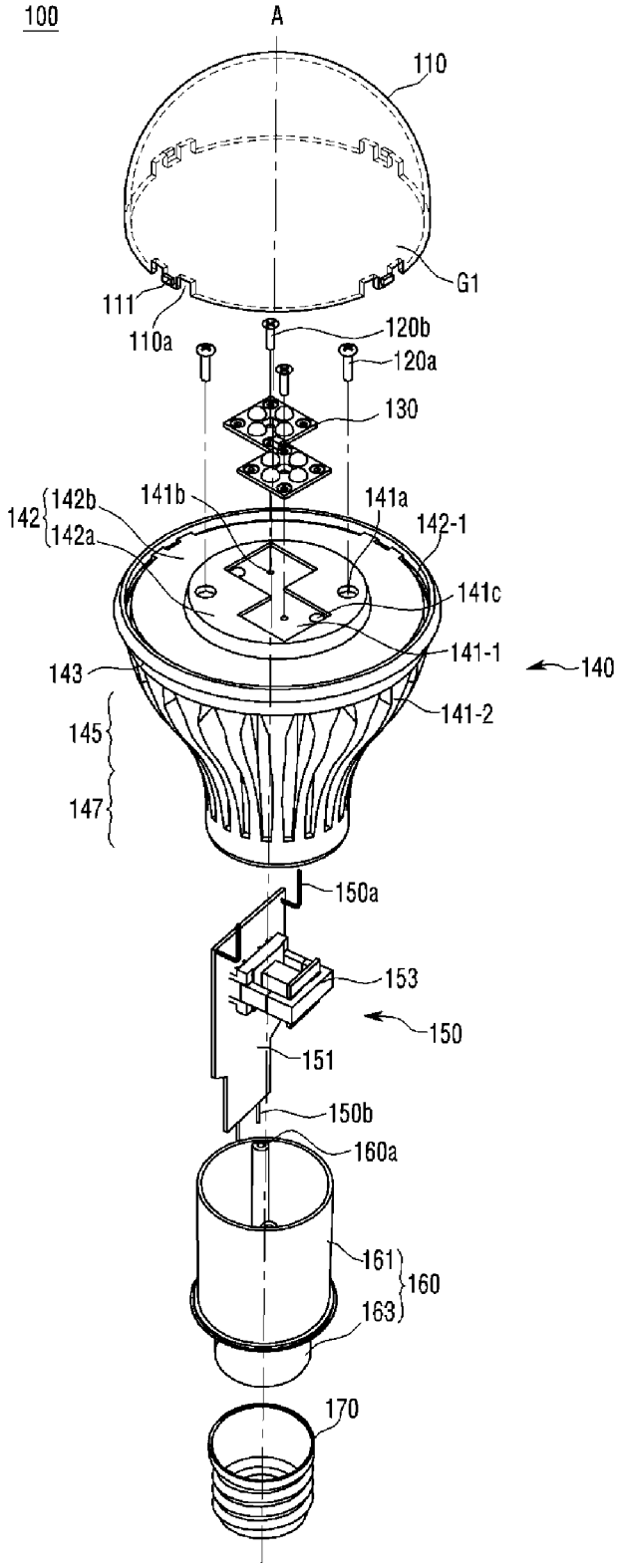
FIG. 2 is an exploded perspective view of the lighting device shown in FIG. 1.
Figure 3:
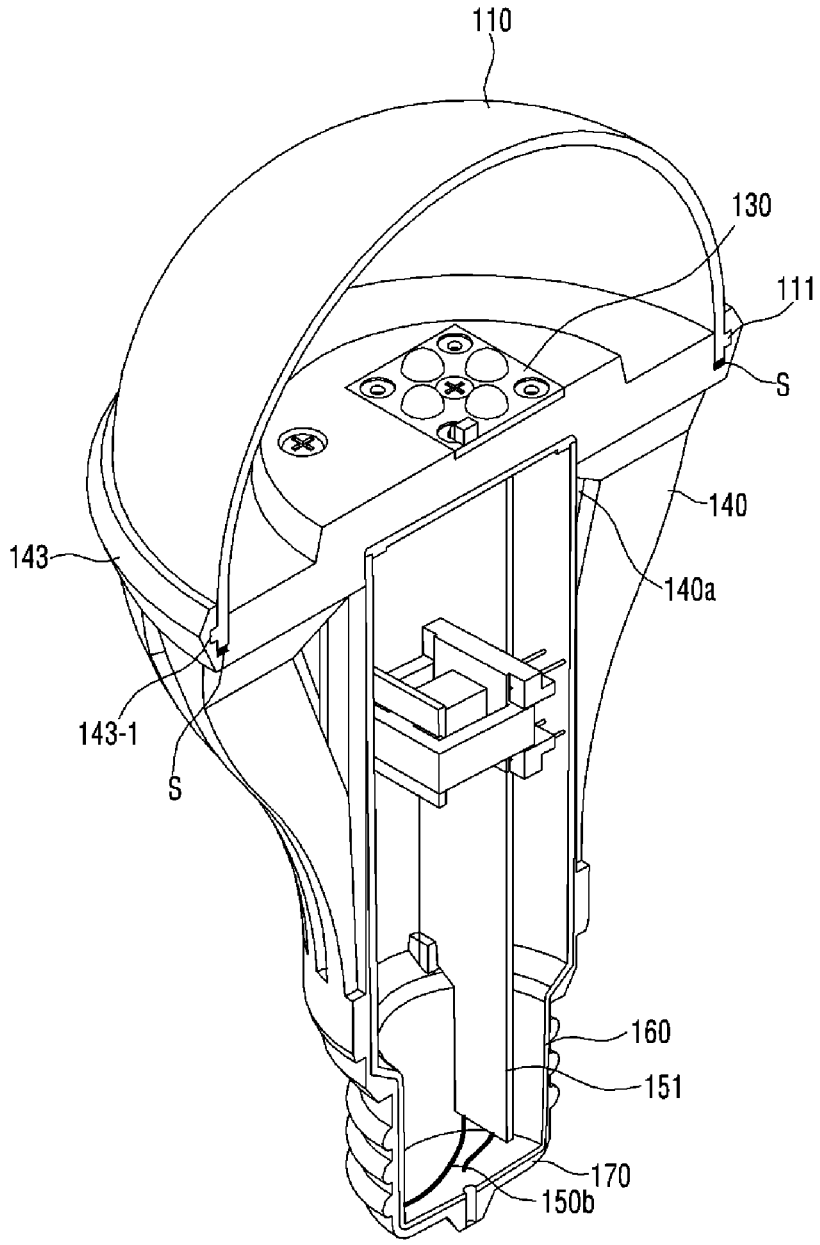
FIG. 3 is a cross sectional view of the lighting device shown in FIG. 1.
Figure 4:
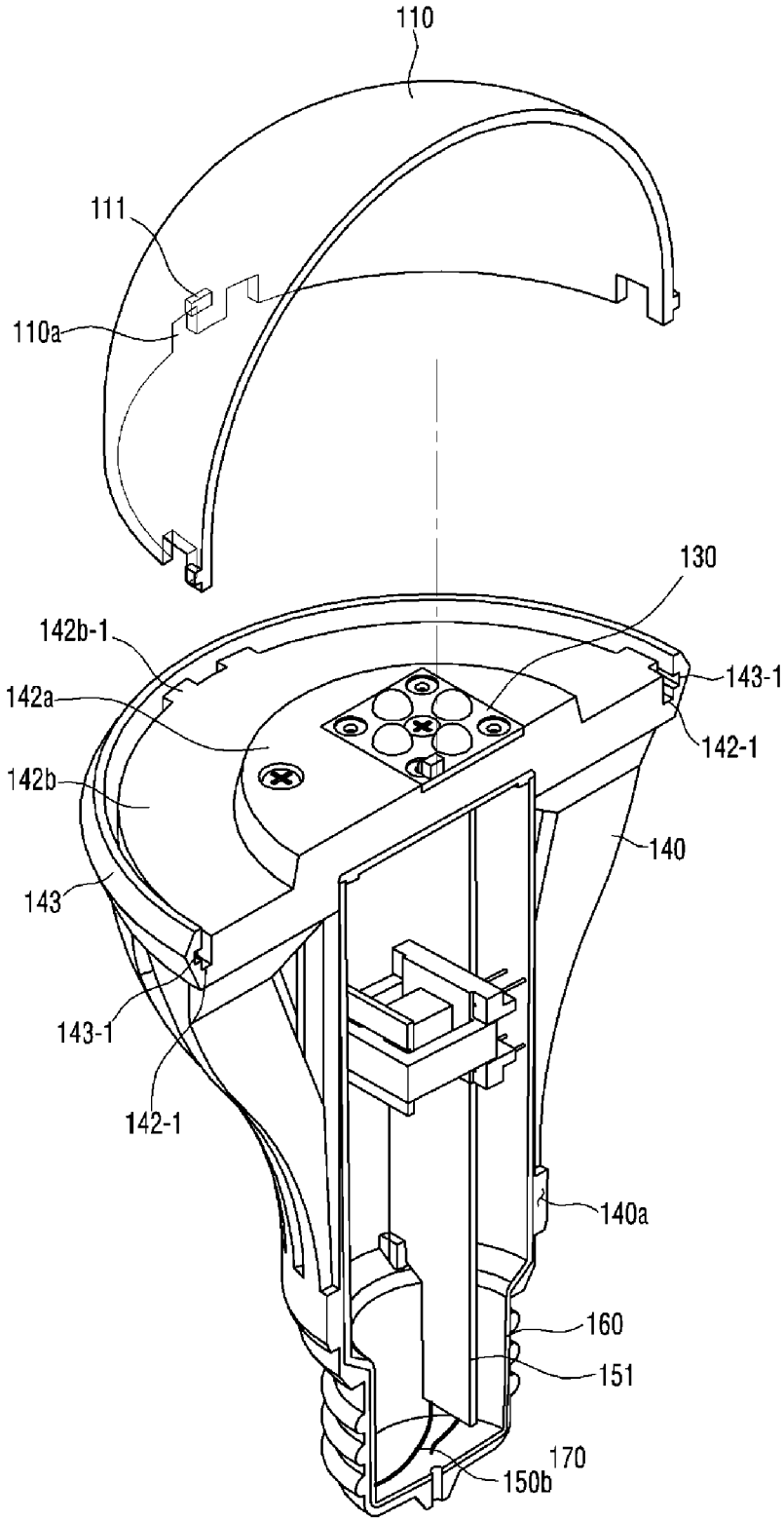
FIG. 4 is an exploded cross sectional view of the lighting device shown in FIG. 3.
Figure 5:
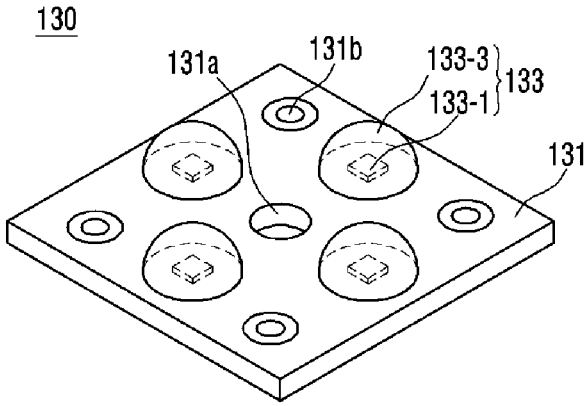
FIG. 5 is a perspective view of a light emitting module shown in FIG. 1.

FIG. 1 is a perspective view showing an embodiment of a lighting device. FIG. 2 is an exploded perspective view of the lighting device shown in FIG. 1. FIG. 3 is a cross sectional view of the lighting device shown in FIG. 1. FIG. 4 is an exploded cross sectional view of the lighting device shown in FIG. 3. FIG. 5 is a perspective view of a light emitting module shown in FIG. 1.

Referring to FIGS. 1 to 5, a lighting device 100 may include a cover 110, a light emitting module 130, a heat sink 140, a power controller 150, an inner case 160 and a socket 170.

The cover 110 surrounds and protects the light emitting module 130 from external impacts. The cover 110 also distributes light generated by the light emitting module 130 to the front or rear (top or bottom) of the lighting device 100.

The heat sink 140 radiates heat generated from the light emitting module 130 due to the drive of the lighting device 100. The heat sink 140 improves heat radiation efficiency through as much surface contact with the light emitting module 130 as possible. Here, the heat sink 140 may be coupled to the light emitting module 130 by using an adhesive. Additionally, it is recommended that they should be coupled to each other by using a fastening means 120*b*, for example, a screw.

The inner case 160 receives the power controller 150 therein, and then is received by the heat sink 140.

Hereafter, the lighting device 100 according to the embodiment will be described in detailed focusing on its constituents.

<Cover>

The cover 110 has a bulb shape having an opening 'G1'. The inner surface of the cover 110 may be coated with an opalesque pigment. The pigment may include a diffusing agent such that light passing through the cover 110 can be diffused throughout the inner surface of the cover 110.

The cover 110 may be formed of glass. However, the glass is vulnerable to weight or external impact. Therefore, plastic, polypropylene (PP) and polyethylene (PE) and the like can be used as the material of the cover 110. Here, polycarbonate (PC), etc., having excellent light resistance, excellent thermal resistance and excellent impact strength property can be also used as the material of the cover 110.

The roughness of the inner surface of the cover 110 is larger than the roughness of the outer surface of the cover 110. When the light emitted from the light emitting module 130 is irradiated to the inner surface of the cover 110 and is emitted to the outside, the light irradiated to the inner surface of the cover 110 can be sufficiently scattered and diffused. Accordingly, light emitting property of the lighting device 100 can be improved.

The cover 110 may be formed through a blow molding process which can increase the orientation angle of the light.

The cover 110 and the heat sink 140 may be coupled to each other by inserting the edge portion of the cover 110 into a groove 142-1 disposed along the outer circumference of the flat surface of the heat sink 140 and by coupling a locking projection 111 formed at the edge portion of the cover 110 to a receiving portion 143-1 formed in the inner surface of a guide 143 of the heat sink 140.

When once the cover 110 and the heat sink 140 are coupled to each other, the locking projection 111 of the cover 110 prevents the cover 110 from separating from the heat sink 140, increases a coupling force between the cover 110 and the heat sink 140, and makes it easier to couple them.

A recess 110*a* may be formed on both side ends of the locking projection 111 formed at the edge portion of the cover 110. The recess 110*a* allows the edge portion of the cover 110 to have an uneven shape. The edge portion having the uneven shape is inserted into the groove 142-1 of the heat sink 140. Here, the groove 142-1 of the heat sink 140 may have a structure corresponding to the uneven shape of the cover 110. That is, the groove 142-1 of the heat sink 140 may have a structure having a predetermined closed position. The groove 142-1 of the heat sink 140 will be described in more detail later.

<Light Emitting Module>

The light emitting module 130 may include a substrate 131 and a light source unit 133 disposed on the substrate 130.

The substrate 131 has a quadrangular shape and there is no limit to the shape of the substrate 130. However, as shown in the embodiment, when the substrate 131 has a quadrangular shape, the substrate 130 has a hole 131*a* in its central portion and a via-hole 131*b* in its corner portion. When a plurality of the substrates 131 are disposed on a specific surface like one surface of the heat sink 140, the via-hole 131*b* can function as a path for wiring or a connector for electrically connecting the adjacent substrates.

The substrate 131 may be formed by printing a circuit pattern on an insulator and may include, for example, a common printed circuit board (PCB), a metal core PCB, a flexible PCB and a ceramic PCB and the like. Here, the substrate 131 may be a chips on board (COB) allowing an unpackaged LED chip to be directly bonded thereon. The COB type substrate includes a ceramic material to obtain insulation and thermal resistance against heat generated by driving the lighting device 100.

The substrate 131 may be also formed of a material capable of efficiently reflecting light, or the surface of the substrate 131 may have color capable of efficiently reflecting light, for example, white and silver and the like.

A plurality of the light source unit 133 may be disposed on the substrate 131. The light source unit 133 may include a light emitting device 133-1 and a lens 133-3.

A plurality of the light emitting device 133-1 may be disposed on one side of the substrate 131. The light emitting device 133-1 may be a light emitting diode chip emitting blue, red or green light or may be a light emitting diode chip emitting UV.

Also, the light emitting diode of the light emitting device 133-1 may have a lateral type or a vertical type. The light emitting diode may emit blue, red or green light.

The lens 133-3 is disposed on the substrate 131 in such a manner as to cover the light emitting device 133-1. The lens 133-3 is able to adjust the orientation angle or direction of light emitted from the light emitting device 133-1.

The lens 133-3 has a hemispherical shape. The inside of the lens 133-3 may be entirely filled with a light transmitting resin like a silicon resin or epoxy resin without an empty space. The light transmitting resin may entirely or partially include distributed fluorescent material.

Here, when the light emitting device 133-1 is a blue light emitting diode, the fluorescent material included in the light transmitting resin of the lens 133-3 may include at least any one selected from a group consisting of a garnet based material (YAG, TAG), a silicate based material, a nitride based material and an oxynitride based material.

Though natural light (white light) can be created by allowing the light transmitting resin to include only yellow fluorescent material, the light transmitting resin may further include a green fluorescent material or a red fluorescent material in order to improve a color rendering index and to reduce a color temperature.

When the light transmitting resin of the lens 133-3 is mixed with many kinds of fluorescent materials, an addition ratio of the color of the fluorescent material may be formed such that the green fluorescent material is more used than the red fluorescent material, and the yellow fluorescent material is more used than the green fluorescent material.

The garnet based material, the silicate based material and the oxynitride based material may be used as the yellow fluorescent material. The silicate based material and the oxynitride based material may be used as the green fluorescent material. The nitride based material may be used as the red fluorescent material.

The lens 133-3 may be formed not only by mixing the fluorescent material with the light transmitting resin, but also by stacking layers including the red, green and yellow fluorescent materials.

<Heat Sink>

The heat sink 140 includes a receiving recess 140*a* into which the power controller 150 and the inner case 160 are inserted.

The heat sink 140 may include both a flat plate 142 having a circular surface and a guide 143 extending substantially perpendicular to the circular flat along the outer circumference of the circular surface.

The flat plate 142 may include both a projection 142*a* projecting along a central axis "A" of the circular surface and a basal surface portion 142*b* having a donut-shaped circular surface which is lower than the projection 142*a*. Here, the basal surface portion 142*b* is disposed to surround the projection 142*a*.

The projection 142*a* and the basal surface portion 142*b* may include one flat surface. The one surface of the projection 142*a* may be disposed higher than that of the basal surface portion 142*b*.

The basal surface portion 142*b* may include the groove 142-1 formed along the outer circumference of the basal surface portion 142*b*. Here, the groove 142-1 may have a structure having a predetermined closed position. The closed position is formed due to a first projection 142*b*-1 projecting toward the guide 143 from the outer circumference of the basal surface portion 142*b*. Here, the first projection 142*b*-1 may connect the outer circumference of the basal surface portion 142*b* with the guide 143. Also, a plurality of the first projection 142*b*-1 may be provided.

The first projection 142*b*-1 is coupled to the recess 110*a* of the cover 110. Therefore, the first projection 142*b*-1 and the recess 110*a* of the cover 110 have shapes corresponding to each other.

A resin "S" such as an adhesive resin is applied in the groove 142-1, so that a coupling force between the cover 110 and the heat sink 140 can be increased. Further, the cover 110 can be completely sealed to the heat sink 140. Here, the resin "S" may be a silicone adhesive material.

A seating recess 141-1 in which at least one light emitting module 130 is disposed may be formed in one surface of the projection 142*a*. Specifically, the substrate 131 of the light emitting module 130 may be disposed in the seating recess 141-1. The seating recess 141-1 may have a shape corresponding to the shape of the substrate 131.

The projection 142*a* may include a first hole 141*a*, a second hole 141*b* and a third hole 141*c* which pass through the one surface thereof. A first screw 120*a* passes through the first hole 141*a* and is coupled to a fastening hole 160*a* disposed on the inner surface of the inner case 160, so that the heat sink 140 is securely coupled to the inner case 160. A second screw 120*b* which has passed through the hole 131*a* of the light emitting module 130 passes through the second hole 141*b* and is coupled to the heat sink 140, so that the heat sink 140 is securely coupled to the light emitting module 130. Accordingly, heat generated from the light emitting module 130 is effectively transferred to the heat sink 140 and heat radiating characteristic can be improved. An electrode pin 150*a* of the power controller 150 passes through the third hole 141*c* and is coupled to the via-hole 131*b* of the light emitting module 130. The power controller 150 is electrically connected to the light emitting module 130 by the coupling of the electrode pin 150*a* and the via-hole 131*b*.

The heat sink 140 may include a cylindrical upper portion 145 which extends upward along the central axis "A" of the flat circular surface and a cylindrical lower portion 147 which extends downward from the cylindrical upper portion 145 and has a diameter decreasing along the central axis "A".

Either the area of the circular surface of the cylindrical upper portion 145 or the height of the cylindrical upper portion 145 may be changed according to the total area of the light emitting module 130 or the entire length of the power controller 150.

A plurality of the fins 141-2 may be disposed on one surface of the cylindrical upper portion 145 in the longitudinal direction of the cylindrical upper portion 145. The plurality of the fins 141-2 may be radially disposed along the one surface of the cylindrical upper portion 145. The plurality of the fins 141-2 increase the area of the one surface of the cylindrical upper portion 145. Accordingly, the heat radiation efficiency can be enhanced.

Here, the fin 141-2 can be disposed on one surface of the cylindrical lower portion 147. That is, the fin 141-2 formed on the one surface of the cylindrical upper portion 145 may extend to the one surface of the cylindrical lower portion 147. More specifically, the fin 141-2 will be described with reference to the accompanying FIG. 6.

Figure 6:
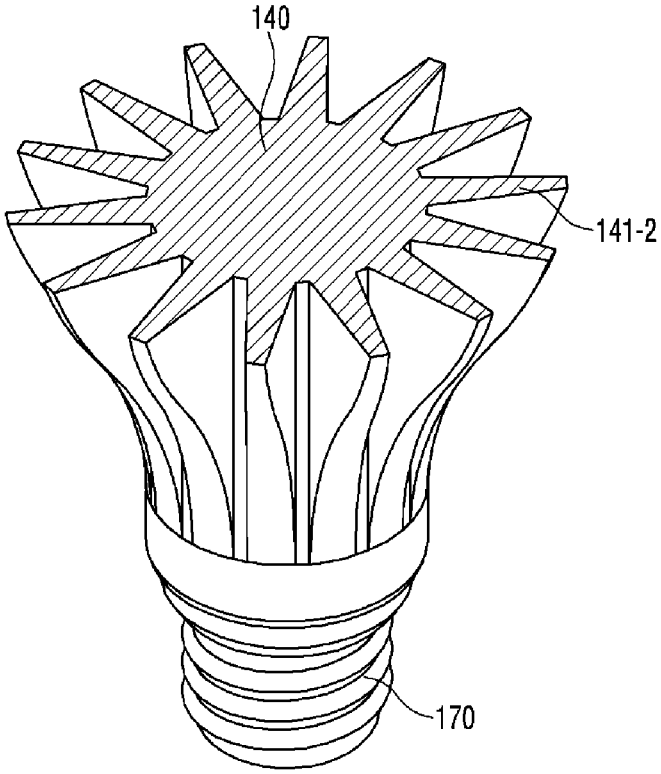
FIG. 6 is a cross sectional view of the heat sink shown in FIG. 1.

FIG. 6 is a cross sectional view of the heat sink shown in FIG. 1.

Referring to FIGS. 1 to 6, the heat sink 140 includes the plurality of the fins 141-2.

The plurality of the fins 141-2 may be disposed on the outer surface, particularly, the lateral surface of the heat sink 140 at a regular interval.

The fin 141-2 may include one end connected to the heat sink 140 and the other end extending from the heat sink 140. Here, the thickness of the other end of the fin 141-2 may be equal to or not equal to that of the one end of the fin 141-2. Besides, the thicknesses of the upper portion and the lower portion of the other end of the fin 141-2 may be different from each other.

The other end of the fin 141-2 may have a curved surface.

The thickness of the other end of the lowest portion of the fin 141-2 may be substantially the same as that of the one end of the lowest portion of the fin 141-2.

The lowest portion of the fin 141-2 may be placed on the same plane with the outer surface of the heat sink 140.

An interval between the plurality of the fins 141-2 is increased in the direction of the extension of the fins 141-2. Due to the increased interval, it is easy to coat the surface of the heat sink 140. Specifically, when the outer surface of the heat sink 140, on which the plurality of the fins 141-2 have been formed, is coated with a predetermined material, it is easy to coat the surface of the fin 141-2 and the surface between the fins 141-2 of the heat sink 140 due to the wide interval between the plurality of the fins 141-2. Here, there are many kinds of methods for coating the heat sink 140 including the fin 141-2. For example, a powder coating process may be used.

The powder coating process is to form a coating film having a predetermined depth on the outer surface of the heat sink 140 by using static electricity, etc., and by using resin powder, for example, epoxy or polyethylene based material as a material of the coating film. The coating film formed by the powder coating process is able to improve corrosion resistance, adhesiveness and durability and the like of the heat sink 140. Also, the coating film causes the heat sink 140 to be less influenced by an external impact and not to be vulnerable to water or moisture.

The coating film by the powder coating process may have a thickness of from 40 μm to 80 μm. This intends to obtain not only various advantages caused by the formation of the coating film by the powder coating process but also a heat radiating characteristic, that is, a unique feature of the heat sink 140.

Here, while the embodiment shows that the outer surface of the heat sink 140 is coated by the powder coating process, the method for coating the outer surface of the heat sink 140 is not limited to this.

Meanwhile, the roughness of the outer surface of the heat sink 140 may be, for example, less than the roughness of the flat circular surface of the heat sink 140 or the roughness of an inner surface defining the receiving recess 140*a* of the heat sink 140.

Again, referring to FIGS. 1 to 5, the guide 143 of the heat sink 140 may include a receiving portion 143-1. The receiving portion 143-1 may be a predetermined recess formed toward the guide 143 in a lateral surface defining the groove 142-1. The locking projection 111 of the cover 110 may be inserted into the receiving portion 143-1. As a result, the cover 110 can be securely coupled to the heat sink 140.

The heat sink 140 is formed of a metallic material or a resin material which has excellent heat radiation efficiency. There is no limit to the material of the heat sink 140. For example, the material of the heat sink 140 can include at least one of Al, Ni, Cu, Ag and Sn.

Though not shown in the drawings, a heat radiating plate (not shown) may be disposed between the light emitting module 130 and the heat sink 140. The heat radiating plate (not shown) may be formed of a material having a high thermal conductivity such as a thermal conduction silicon pad or a thermal conduction tape and the like, and is able to effectively transfer heat generated by the light emitting module 130 to the heat sink 140.

<Power Controller>

The power controller 150 includes a support plate 151 and a plurality of parts 153 mounted on the support plate 151. The plurality of the parts 153 includes, for example, a DC converter converting AC power supplied by an external power supply into DC power, a driving chip controlling the driving of the light emitting module 130, and an electrostatic discharge (ESD) protective device for protecting the light emitting module 130, and the like. However, there is no limit to the parts.

The power controller 150 may include the electrode pin 150*a* which projects outwardly from the support plate 151 or is connected to the support plate 151.

The electrode pin 150*a* may pass through the third hole 141*c* formed in the cylindrical upper portion 141 of the heat sink 140, and may be inserted into the via-hole 131*b* of the light emitting module 130. The electrode pin 150*a* supplies electric power to the light emitting module 130 from the power controller 150.

<Inner Case>

The inner case 160 may include an insertion portion 161 which is inserted into the receiving recess 140*a* of the heat sink 140, and a connector 163 coupled to the socket 170. The insertion portion 161 receives the power controller 150.

The inner case 160 may be formed of a material having excellent insulation and durability, for example, a resin material.

The insertion portion 161 has a cylindrical shape with an empty interior. The insertion portion 161 is inserted into the receiving recess 140*a* of the heat sink 140 and prevents electrical contact between the power controller 150 and the heat sink 140. Therefore, a withstand voltage of the lighting device 100 can be improved by the insertion portion 161.

The insertion portion 161 may include the fastening hole 160*a*. The fastening hole 160*a* may be formed in the inner surface of the insertion portion 161. The first screw 120*a* which has passed through the first recess 141*a* of the heat sink 140 is inserted into the fastening hole 160*a*.

<Socket>

The socket 170 is coupled to the connector 163 of the inner case 160 and is electrically connected to an external power supply.

Figure 7:
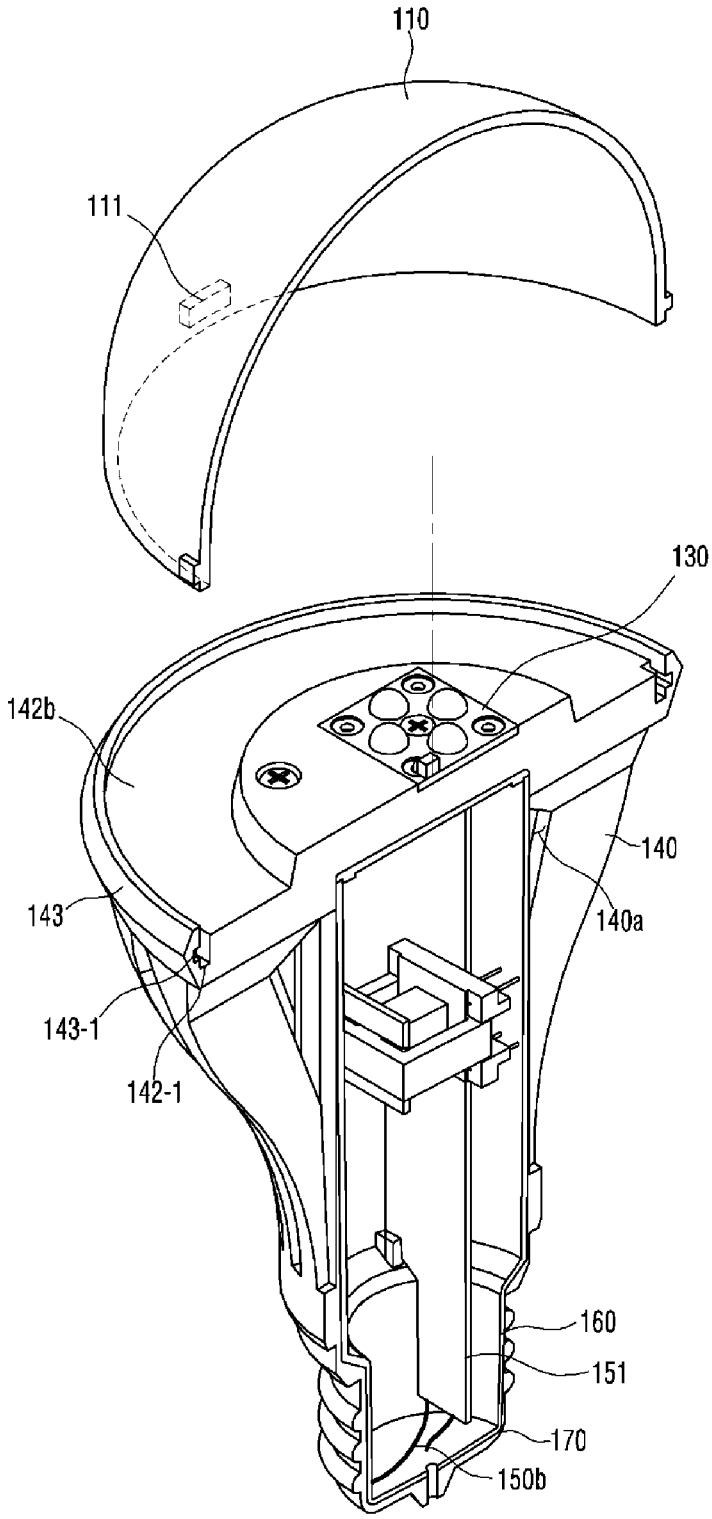
FIGS. 7 and 8 are sectional perspective views showing modified examples of the lighting device according to the embodiment.
Figure 8:
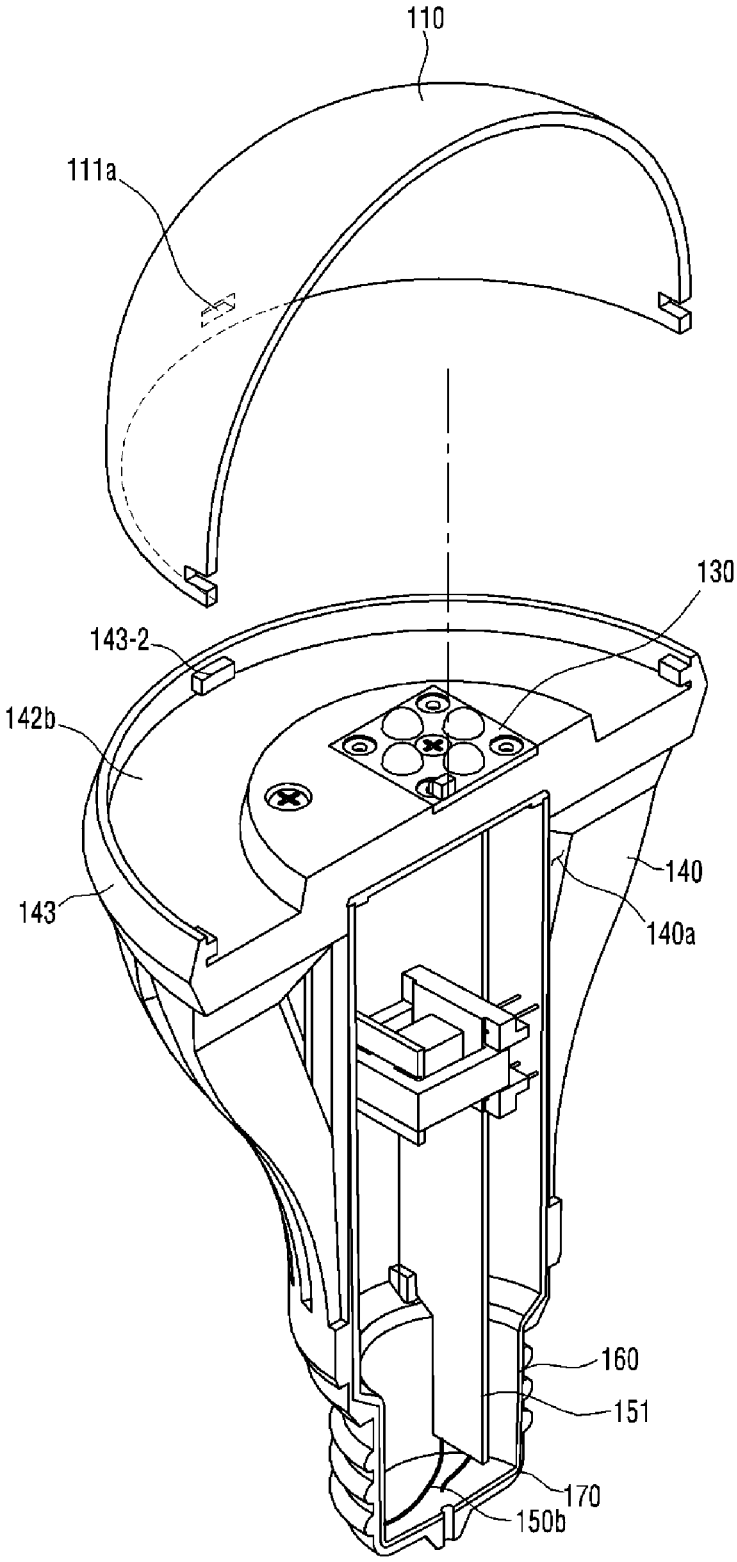

FIGS. 7 and 8 are sectional perspective views showing modified examples of the lighting device according to the embodiment.

First, referring to FIG. 7, the guide 143 of the heat sink 140 includes the receiving portion 143-1. The heat sink 140 includes the groove 142-1 formed along the outer circumference of the basal surface portion 142*b*. The end of the cover 110 includes the locking projection 111 received by the receiving portion 143-1 of the guide 143.

Through a comparison of the embodiment shown in FIG. 7 with the embodiment shown in FIG. 4, it can be seen that the end of the cover 110 shown in FIG. 7 is smooth without an uneven structure. Accordingly, the groove 142-1 formed along the outer circumference of the basal surface portion 142*b* of the heat sink 140 may have a circular shape without a closed structure.

Referring to FIG. 8, the guide 143 of the heat sink 140 includes a projection 143-2. The end of the cover 110 includes a hole 111*a* into which the projection 143-2 is inserted. Due to the projection 143-2 and the hole 111*a*, the cover 110 can be securely coupled to the heat sink 140.

<Mechanical and Electrical Connection Structure Between the Power Controller and the Inner Case>

The power controller 150 may be disposed in the receiving recess 140*a* of the heat sink 140.

The support plate 151 of the power controller 150 may be disposed perpendicularly with respect to one side of the substrate 131 such that air flows smoothly in the inner case 160. Accordingly, as compared with a case where the support plate 151 is disposed horizontally with respect to one side of the substrate 131, air flows up and down in the inner case 160 due to convection current, thereby improving the heat radiation efficiency of the lighting device 100.

Meanwhile, the support plate 151 may be disposed in the inner case 160 perpendicularly to the longitudinal direction of the inner case 160. There is no limit to how the support plate 151 is disposed.

The power controller 150 may be electrically connected to the socket 170 through a first wiring 150*b* and may be electrically connected to the light emitting module 130 through the electrode pin 150*a*. Specifically, the first wiring 150*b* is connected to the socket 170, and then can be supplied an electric power from an external power supply. Also, the electrode pin 150*a* passes through the third recess 141*c* of the heat sink 140 and is able to electrically connect the power controller 150 with the light emitting module 130.

Figure 9:
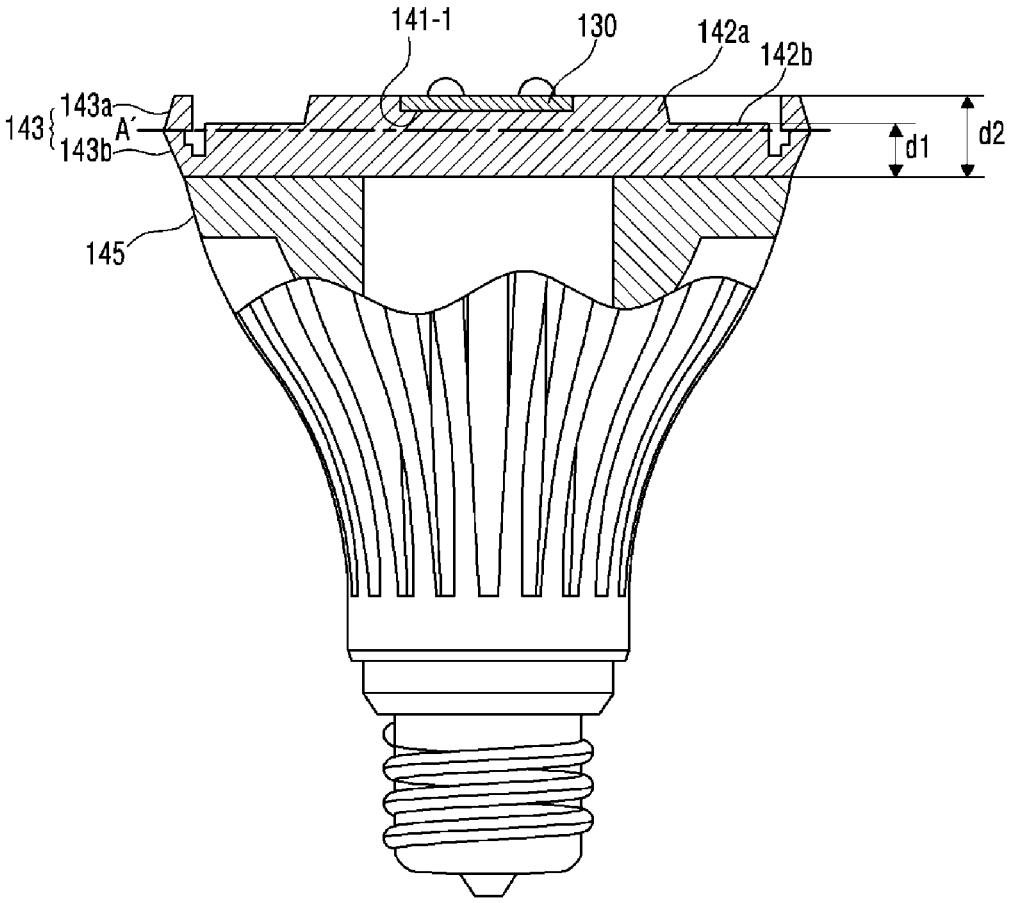
FIG. 9 is a cross sectional view showing a coupling structure of the light emitting module and the heat sink of the lighting device shown in FIG. 1.

FIG. 9 is a cross sectional view showing a coupling structure of the light emitting module and the heat sink of the lighting device shown in FIG. 1.

Referring to FIG. 9, the heat sink 140 may include the basal surface portion 142*b* and the projection 142*a* having a thickness "d2" larger than a thickness "d1" of the basal surface portion 142*b*.

The light emitting module 130 is disposed on one surface of the projection 142*a*. Specifically, the light emitting module 130 is disposed in the seating recess 141-1 formed in the one surface of the projection 142*a*. As such, when the light emitting module 130 is disposed on the projection 142*a* instead of the basal surface portion 142*b*, the heat generated from the operation of the light emitting module 130 can be more effectively radiated. This is because the thickness "d2" of the projection 142*a* is larger than the thickness "d1" of the basal surface portion 142*b*.

The height of the projection 142*a*, that is, a length from one surface of the basal surface portion 142*b* to the end of the projection 142*a* may be the same or larger than the thickness of the substrate of the light emitting module 130. In this case, when the light emitting module 130 is disposed in the seating recess 141-1 of the projection 142*a* of the heat sink 140, the light emitting module 130 is disposed in the seating recess 141-1 of the projection 142*a* as deeply as possible, so that a contact area of the light emitting module 130 and the heat sink 140 is maximally increased. As a result, heat radiating characteristic of the lighting device 100 can be improved.

The end of the projection 142*a* of the heat sink 140 may be higher than the end of the guide 143 of the heat sink 140 or may be at least placed on the same line with the end of the guide 143 of the heat sink 140. This intends that the light emitted from the light emitting module 130 disposed in the projection 142*a* is at least not blocked by the guide 143 of the heat sink 140.

The guide 143 of the heat sink 140 may extend outward from the cylindrical upper portion 145 of the heat sink 140.

The guide 143 may include a first member 143*a* and a second member 143*b* which extends from the first member 143*a*. The first member 143*a* and the second member 143*b* are structures having a ring shape and may be individually manufactured and adhered to each other or may be integrally injection-molded.

The materials of the first member 143*a* and the second member 143*b* may or may not be the same as the material of the heat sink 140.

The first member 143*a* may be inclined at a first inclination with respect to the lateral surface of the cylindrical upper portion 145. The second member 143*b* may be inclined at a second inclination different from the first inclination of the first member 143*a*. The first member 143*a* may be inclined inwardly from the central axis of the cylindrical upper portion 145. The second member 143*b* may be inclined outwardly from the central axis of the cylindrical upper portion 145.

It is premised that a portion where the first member 143*a* and the second member 143*b* are in contact with each other is a reference axis "A'". One surface of the first member 143*a* and one surface of the second member 143*b* may be inclined at the same angle with respect to the reference axis "A'" or may be inclined at different angles with respect to the reference axis "A'".

The guide 143 having the aforementioned structure is disposed in the heat sink 140 and surrounds the cover 110 protecting the light emitting module 130, causing the cover 110 and the heat sink 140 to be stably coupled to each other.

FIGS. 10*a* to 10*h* are views for describing an assembly process of the lighting device shown in FIG. 2.

Figure 10A:
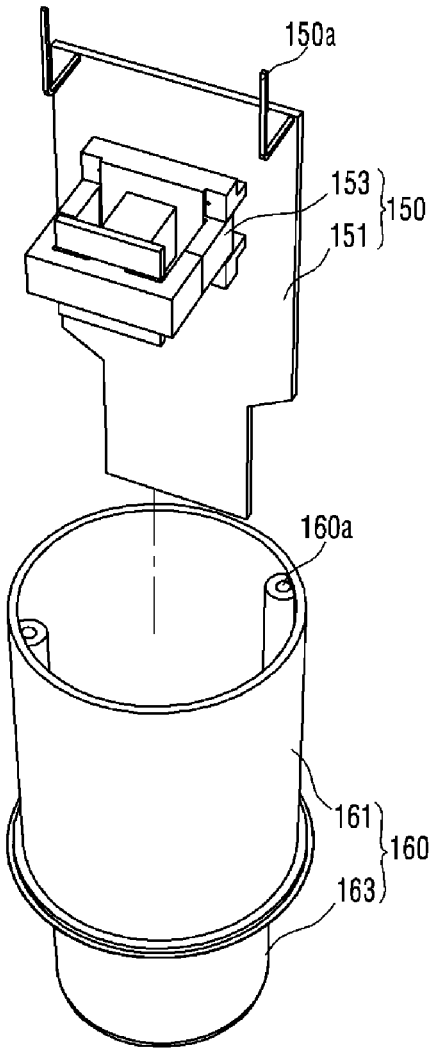
FIGS. 10*a* to 10*h* are views for describing an assembly process of the lighting device shown in FIG. 2.

Referring to FIG. 10*a*, the power controller 150 is inserted into the insertion portion 161 of the inner case 160. Here, though not shown, a guider groove (not shown) may be formed in the inner surface of the inner surface 160 such that the support plate 151 of the power controller 150 is coupled to the inner surface of the inner case 160 in a sliding manner. The guider groove (not shown) may be formed in the longitudinal direction of the inner case 160.

Figure 10B:
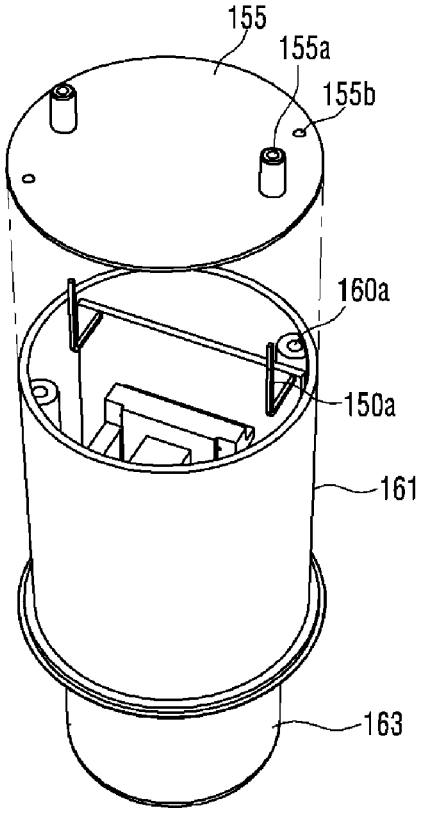
Figure 10C:
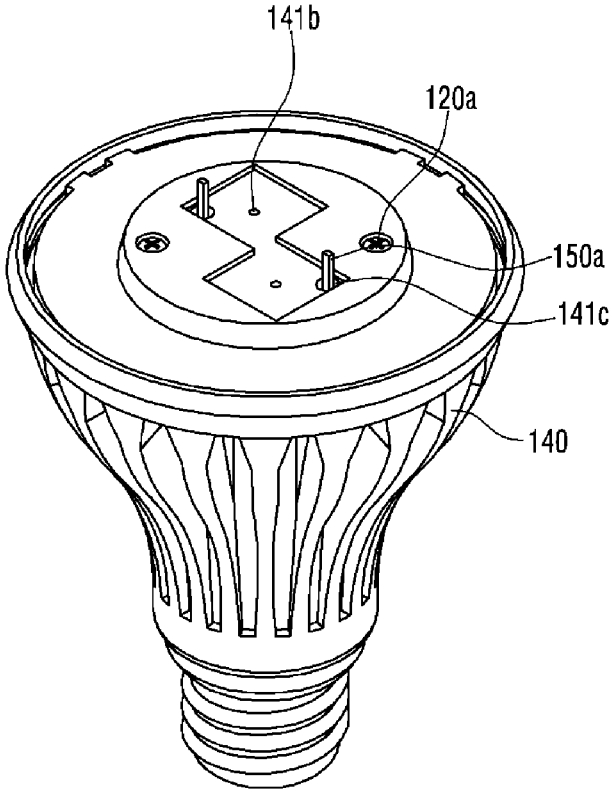

Next, referring to FIG. 10*b*, a holder 155 is located at the end of the insertion portion 161 of the inner case 160 and seals the inner case 160 such that the electrode pin 150*a* of the power controller 150 disposed in the insertion portion 161 of the inner case 160 is securely fixed and electrically coupled to the light emitting module 130. Here, the holder 155 includes a protrusion portion 155*a* having a through-hole allowing the electrode pin 150*a* to pass through the through-hole. The holder 155 also includes an auxiliary hole 155*b* allowing the first screw 120*a* fastening the heat sink 140 to the inner case 160 to pass through the auxiliary hole 155*b*. Since the holder 155 functions as a means for securely fixing and supporting the electrode pin 150*a*, the holder 155 may not be used in some cases.

Next, referring to FIG. 10*b*, an assembly of the inner case 160 and the power controller 150 is coupled to the heat sink 140. In this case, the insertion portion 161 of the inner case 160 is inserted into the receiving recess 140*a* of the heat sink 140 shown in FIG. 3. The inner case 160 and the heat sink 140 are fixed by the first screw 120*a*. Here, the electrode pin 150*a* of the power controller 150 passes through the third hole 141*c* of the heat sink 140 and projects.

Figure 10D:
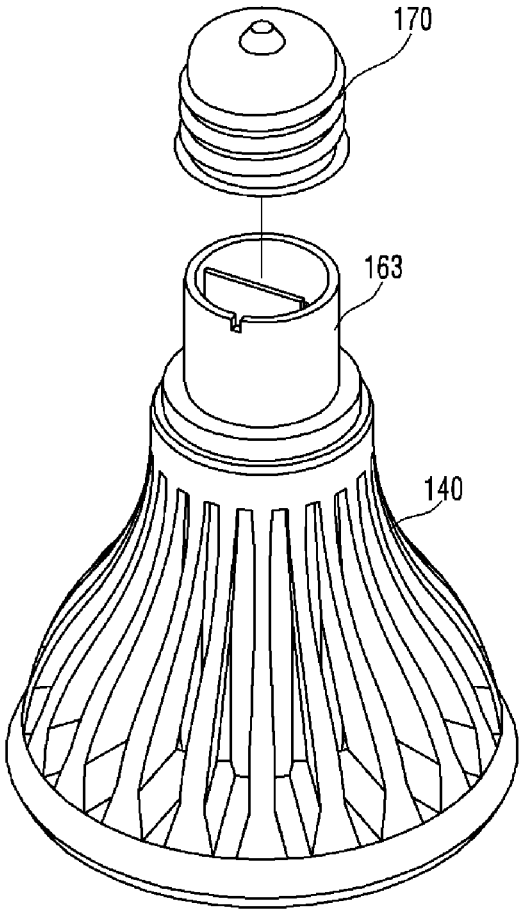

Referring to FIG. 10*d*, the socket 170 is coupled to the connector 163 of the inner case 160. Through a wiring connection, the socket 170 is electrically connected to the power controller 150 disposed in the inner case 160.

Figure 10E:
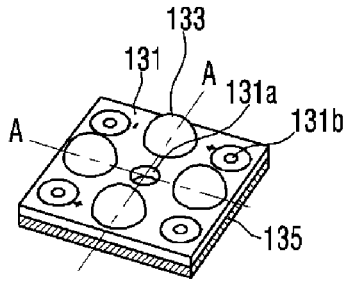

Referring to FIG. 10*e*, a thermal grease 134 is applied on the bottom surface of the substrate 131 of the provided light emitting module 130. The light emitting module 130 includes a plurality of the light source units 133. The light source units 133 are disposed symmetrically with each other with respect to the hole 131*a* formed at the center of the substrate 131. Specifically, the light source units 133 are disposed on the substrate 131 symmetrically up, down, right and left with respect to the hole 131*a* formed at the center of the substrate 131. Though the light source units 133 may be disposed on the substrate 131 in various forms, it is recommended that the light source units 133 should be disposed symmetrically with respect to the hole 131*a* for the purpose of improvement of the uniformity characteristics of light emitted from the light source units 133.

Figure 10F:
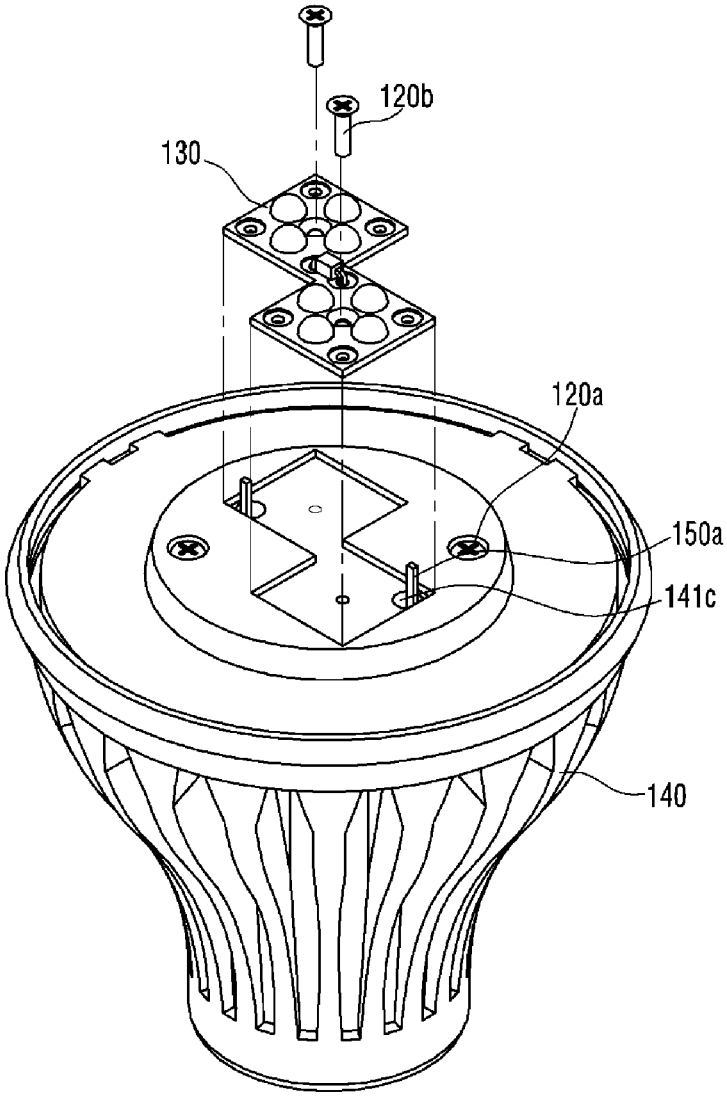

Referring to FIG. 10*f*, the light emitting module 130 and an assembly including the inner case 160, the power controller 150 and the heat sink 140 are coupled to each other by using the second screw 120*b*. Here, the second screw 120*b* fixes the light emitting module to the assembly by passing through the hole 131 formed at the central portion of the light emitting module 130 and the second hole 141*b* of the heat sink 140.

Figure 10G:
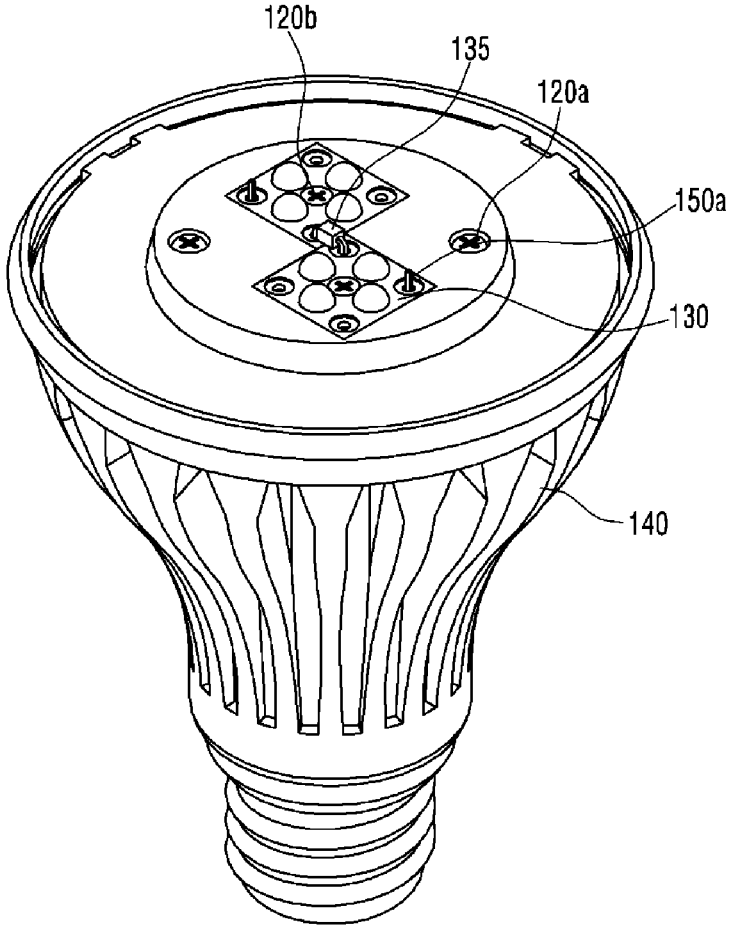

Referring to FIG. 10*g*, a connector 135 is connected to each via-hole 131*b* of two light emitting modules 130 such that the two light emitting modules 130 are electrically connected to each other. Here, the electrode pin 150*a* of the power controller 150 is soldered in such a manner as to be electrically connected to the substrate 131 of the light emitting module 130.

Figure 10H:
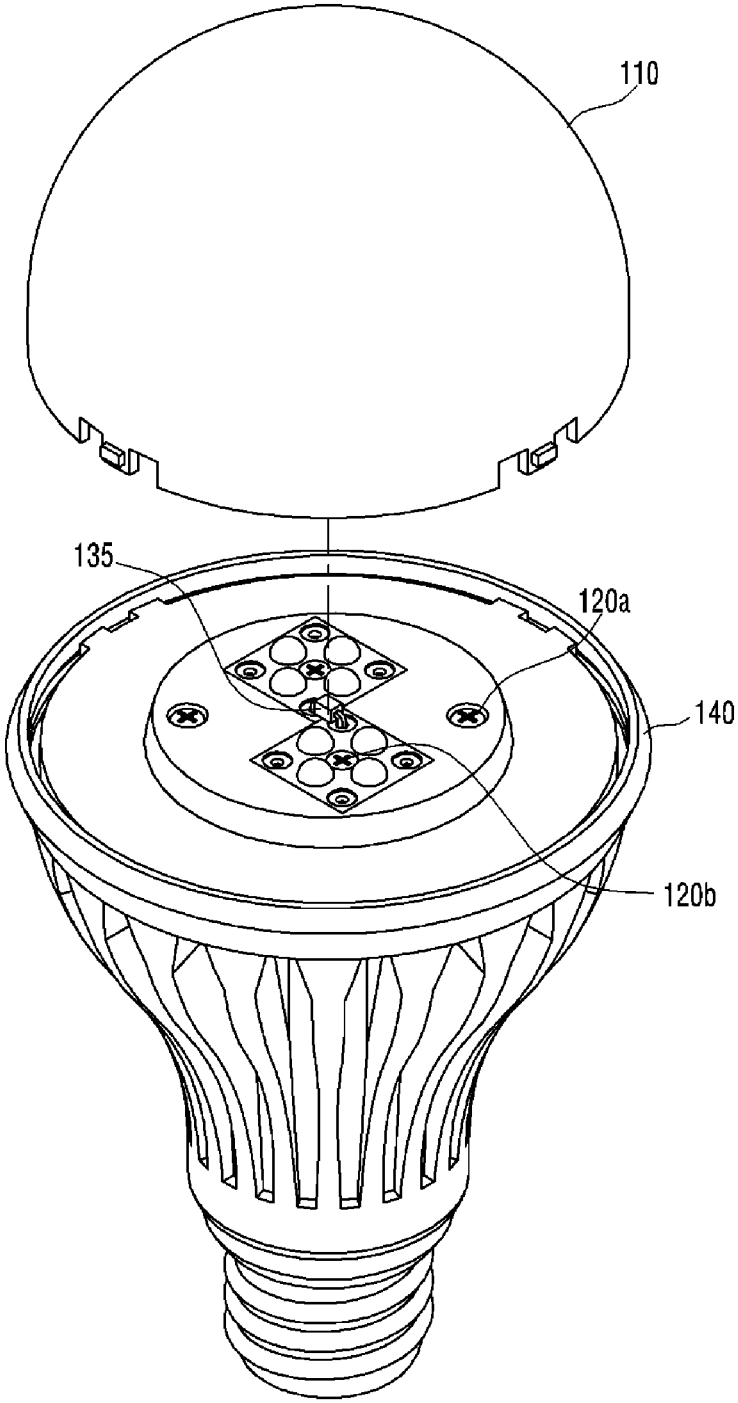

Referring to FIG. 10*h*, the cover 110 is silicon-bonded and coupled to the heat sink in such a manner as to cover the light emitting module 130.

Since the lighting device 100 has a structure capable of substituting for a conventional incandescent bulb, it is possible to use equipments for the conventional incandescent bulb without the use of a mechanical connection structure for a new lighting device or without the improvement of assembly.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a heat sink which includes one surface, a receiving portion, and a first projection disposed on an outer circumference of the one surface;

a light emitting module which is disposed on the one surface of the heat sink; and a cover which is coupled to the heat sink and includes a locking projection coupled to the receiving portion of the heat sink, and includes a recess coupled to the first projection of the heat sink, wherein the heat sink and the cover are limited to separate from each other by the coupling of the locking projection and the receiving portion, wherein the cover is limited to rotate by the coupling of the first projection and the recess of the cover, wherein the light emitting module includes a light emitting diode, and wherein the one surface of the heat sink comprises:

a second projection which projects upwardly and includes the light emitting module disposed thereon; and a basal surface portion which surrounds the second projection and includes the first projection.

2. The lighting device of claim 1, further comprising a fin connected to an outer surface of the heat sink.

3. The lighting device of claim 2, further comprising a coating film which is disposed on the outer surface of the heat sink and an outer surface of the fin.

4. The lighting device of claim 3, wherein the coating film has a thickness of from 40 μm to 80 μm.

5. The lighting device of claim 2, wherein the fin has a curved outer surface.

6. The lighting device of claim 1, further comprising a plurality of fins connected to an outer surface of the heat sink, wherein the fins are arranged around a circumference of the heat sink.

7. The lighting device of claim 6, wherein each of the fins has a curved outer surface.

8. The lighting device of claim 1, wherein the heat sink comprises a guide and a groove formed between the one surface and the guide, and wherein the cover is inserted into the groove.

9. The lighting device of claim 1, wherein the recess of the cover comprises a first recess and a second recess, the locking projection of the cover is disposed between the first recess and the second recess, and the first projection comprises two projections one of which is inserted into the first recess while the other is inserted into the second recess.

10. The lighting device of claim 1, wherein the heat sink comprises a guide and the first projection is connected to the guide.

11. The lighting device of claim 1, wherein the second projection comprises a seating recess and wherein the light emitting module is disposed in the seating recess.

12. The lighting device of claim 11, wherein the bottom surface of the seating recess is disposed higher than the basal surface portion.

13. The lighting device of claim 11, wherein the seating recess comprises at least two seating recesses partially connected to each other.

14. A lighting device comprising:

a heat sink which includes one surface, a guide including a receiving portion, and a first projection disposed on an outer circumference of the one surface;

a light emitting module which is disposed on the one surface of the heat sink; and a cover which is coupled to the heat sink and includes a locking projection coupled to the receiving portion of the heat sink, and includes a recess coupled to the first projection of the heat sink, wherein the heat sink and the cover are limited to separate from each other by the coupling of the locking projection and the receiving portion, wherein the cover is limited to rotate by the coupling of the first projection and the recess of the cover, wherein the light emitting module includes a light emitting diode, and wherein the guide comprises:

a first member which has a first inclination, and a second member which extends from the first member and has a second inclination different from the first inclination.

15. The lighting device of claim 14, wherein a portion where the first member and the second member are in contact with each other is used as a reference axis, and wherein one surface of the first member and one surface of the second member are inclined at the same angle with respect to the reference axis.

16. The lighting device of claim 14, wherein the first member and the second member are integrally formed with each other.

17. The lighting device of claim 1, wherein the heat sink comprises a receiving recess, and the light emitting module comprises:

a substrate which is disposed on the one surface of the heat sink and includes a via-hole, and the light emitting diode disposed on the substrate, the lighting device further comprising:

a power controller disposed in the receiving recess and includes an electrode pin which passes through the one surface of the heat sink and is inserted into the via-hole of the light emitting module; and an inner case which includes the power controller disposed therein and is received in the receiving recess of the heat sink.

18. The lighting device of claim 17, further comprising a holder which is coupled to the inner case in order to seal the power controller and includes an insulating portion for insulating the electrode pin from the heat sink.

19. A lighting device comprising:

a heat sink including a flat surface and a guide which is disposed on an outer circumference of the surface and includes a projection;

a light emitting module disposed on the surface; and a cover being coupled to the guide of the heat sink and including a hole corresponding to the projection, wherein the cover is limited to rotate by the coupling of the projection of the guide and the hole of the cover, and wherein the heat sink and the cover are limited to separate from each other by the coupling of the projection of the guide and the hole of the cover, and wherein the light emitting module includes a semiconductor based light emitting device.

* * * * *